US008002681B2

(12) United States Patent
Kopp

(10) Patent No.: US 8,002,681 B2
(45) Date of Patent: Aug. 23, 2011

(54) RESISTANCE TRAINING TOOL

(75) Inventor: Todd Kopp, Newburyport, MA (US)

(73) Assignee: CoreAthletics LLC, Amesbury, MA (US)

( * ) Notice: Subject to any disclaimer, the term of this patent is extended or adjusted under 35 U.S.C. 154(b) by 0 days.

(21) Appl. No.: 12/607,783

(22) Filed: Oct. 28, 2009

(65) Prior Publication Data

US 2010/0113231 A1 May 6, 2010

Related U.S. Application Data

(60) Provisional application No. 61/109,876, filed on Oct. 30, 2008.

(51) Int. Cl.
*A63B 21/02* (2006.01)

(52) U.S. Cl. ..... 482/124

(58) Field of Classification Search ..... 482/121–130, 482/148, 907–908, 139, 91
See application file for complete search history.

(56) References Cited

U.S. PATENT DOCUMENTS

| | | | | |
|---|---|---|---|---|
| 2,498,006 | A * | 2/1950 | Ridill | 473/217 |
| 5,308,305 | A * | 5/1994 | Romney | 482/124 |
| 6,220,994 | B1 * | 4/2001 | Rich | 482/123 |
| 6,884,202 | B2 | 4/2005 | Erwin | |
| 7,261,679 | B2 * | 8/2007 | Sload | 482/124 |
| 7,707,652 | B2 * | 5/2010 | Senegal | 2/102 |
| 2005/0130814 | A1 * | 6/2005 | Nitta et al. | 482/121 |
| 2006/0135329 | A1 * | 6/2006 | Owen | 482/123 |
| 2006/0183609 | A1 * | 8/2006 | Flynn | 482/124 |
| 2009/0305827 | A1 * | 12/2009 | Webb et al. | 473/458 |

OTHER PUBLICATIONS

KB's Instructions, instruction sheet which provides instructions for a knee band product that was on sale earlier than Oct. 2007.

* cited by examiner

*Primary Examiner* — Lori Baker
(74) *Attorney, Agent, or Firm* — Hamilton, Brook, Smith & Reynolds, P.C.

(57) ABSTRACT

A resistance training tool having at least one elastic resistance member. The resistance member can include an elastic segment and a swivel clip, attached to each end of the elastic segment, that rotates independently of the elastic segment about an axis defined by the length of the elastic segment.

19 Claims, 9 Drawing Sheets

RESISTANCE TRAINING TOOL

RELATED APPLICATION

This application claims the benefit of U.S. Provisional Application No. 61/109,876, filed on Oct. 30, 2008. The entire teachings of the above application are incorporated herein by reference.

BACKGROUND

People use a variety of approaches to attain and maintain physical fitness. Physical fitness may include strength, flexibility, cardiovascular endurance, speed, balance, coordination, stamina, or other attributes (e.g., ability to perform specific tasks such as jumping or throwing a football). Many aspects of physical fitness can be realized by performing exercises that do not require special equipment, e.g., jogging, or push-ups. However, various exercise tools have been developed to enable individuals to achieve their physical fitness goals efficiently and consistently.

Physical training equipment is available in a variety of forms. From simple weight sets and exercise balls to sophisticated exercise machines typically only found in fitness centers, training tools share a common purpose: to augment the training capabilities of the human body alone. Undeniably, individuals must themselves exert sheer effort in order to achieve their fitness goals, but the tools they use may make the training process more efficient.

Conventional free weights, such as barbells and dumbbells, are renowned for their simplicity and versatility. One can perform many different free weight exercises to target various parts of the body by using gravity to counter muscular contractions. Some devices (e.g., bench racks and Smith machines) use weights in constrained manners (e.g., by constraining a range of motion). Other devices use a combination of weight stacks, rods, pulleys, and other mechanical means to provide gravity-based resistance for specific exercises. Yet other devices (e.g., rowing machines) use other means of resistance, such as hydraulic (shocks-based), water-based, air-based, or magnetic resistance.

These devices have several disadvantages. Free weights and machines are cumbersome. A set of fixed dumbbells, spanning a range of weights that might reasonably be needed to target various parts of the body, takes up a considerable amount of space. Adjustable barbells or dumbbells, which allow the addition or removal of weight plates, solve this problem but require time to make the adjustments. Training machines are typically large and target only a limited range of body parts. Individuals typically find it unaffordable to buy enough machines to target the entire body. Even machines that have been designed to provide a full-body workout while occupying a minimal footprint, e.g., certain machines by Bowflex®, suffer from another drawback shared by all of the foregoing devices: lack of portability. Additionally, many of the foregoing devices are not suitable for all people (e.g., children) to use.

SUMMARY

The present invention addresses the foregoing disadvantages of conventional training tools. Embodiments of the invention use elastic resistance members to provide resistance to stretching in different ways in order to provide a full body workout.

An embodiment of the invention is a resistance training tool comprising at least one elastic resistance member, the resistance member comprising an elastic segment and a swivel clip, attached to each end of the elastic segment, that rotates independently of the elastic segment about an axis defined by the length of the elastic segment.

Another embodiment of the tool includes a thigh/arm sleeve comprising a main portion sized so as to accommodate a thigh of a person, hook-and-loop securing means for securing one end of the main portion to the other end; a tab portion projecting beyond an end of the main portion for attachment, and at least three rings secured to the thigh/arm sleeve, the rings enabling clipping of a resistance member to the thigh/arm sleeve.

Another embodiment of the tool includes a handle attachment comprising a webbing member, a handle portion attached at one end of the webbing member, and at least one ring secured to webbing member.

Another embodiment of the tool includes a harness comprising at least one webbing member, means for attaching the a webbing member around the torso of a person and at least one ring secured to a webbing member.

Another embodiment of the tool includes a wrist/ankle sleeve comprising a member sized so as to fit around an ankle of a person, securing means for securing one end of the member to the other end, and at least one ring secured to the member.

An embodiment of the invention is a method of resistance training comprising attaching one end of an elastic resistance member to a material fixed to the torso area of a person, attaching the other end of the elastic resistance member to a material fixed to an upper arm of the person, and moving the arm so as to extend the elastic resistance member.

Another embodiment of the method comprises attaching one end of an elastic resistance member to a material fixed to an ankle of a person, attaching the other end of the elastic resistance member to a material fixed to a part of the person's body, and moving the ankle so as to extend the elastic resistance member.

Another embodiment of the method comprises attaching one end of an elastic resistance member to a material fixed to a wrist of a person, attaching the other end of the elastic resistance member to a material fixed to a part of the person's body, and moving the wrist so as to extend the elastic resistance member.

BRIEF DESCRIPTION OF THE DRAWINGS

The foregoing will be apparent from the following more particular description of example embodiments of the invention, as illustrated in the accompanying drawings. The drawings are not necessarily to scale, emphasis instead being placed upon illustrating embodiments of the present invention.

DETAILED DESCRIPTION

A description of example embodiments of the invention follows.

Embodiments of the invention tool generally include elastic resistance members that resist stretching, thus countering muscular contractions. By anchoring one end of a resistance member and extending the other end via muscular exertion, resistance training may be used in a variety of configurations to target different parts of the body. Invention embodiments include various mechanisms for anchoring one end of a resistance member as described above, including using sleeves or a harness. An embodiment uses a handle that may be gripped for some exercises.

FIGS. 1-5 show details of embodiments of the invention.

Figure 1:
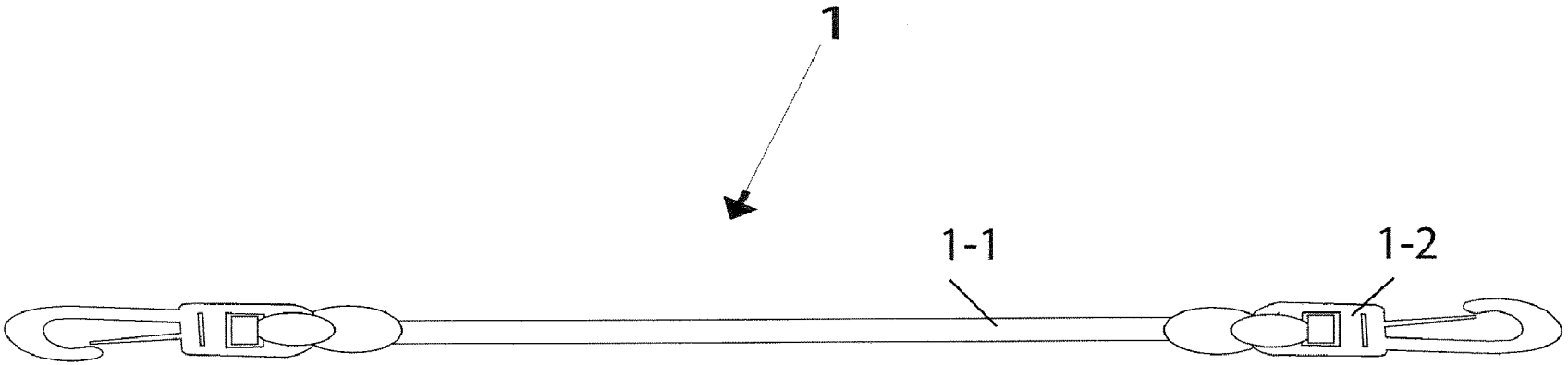
FIG. 1 shows elastic resistance members in an embodiment of the invention.

Referring to FIG. 1, an elastic resistance member (1) provides resistance in an embodiment of the invention. The resistance member includes tubing (1-1) formed from an elastic material, such as rubber, into an elastic segment. The elastic segment may be extended by a stretching force in a range that accommodates a variety of stretching exercise, e.g., about two to seven feet, without breaking. In any case, the segment returns to the unstretched state upon removal of the stretching force.

Each end of the elastic segment is attached to a swivel clip (1-2) that rotates (swivels), independently of the segment, about an axis defined by the length of the elastic segment. The swivel clip may be any conventional mechanical apparatus that includes a hook portion at the end and a means for opening and closing a loop including the hook. The loop may be opened to allow a loop-like object (such as a ring) to pass through. The loop may then be closed so that the hook, specifically the curved portion of the hook, is linked with the object passing through it in interlocking fashion, in which case the resistance member is said to be clipped to the object.

Figure 2A:
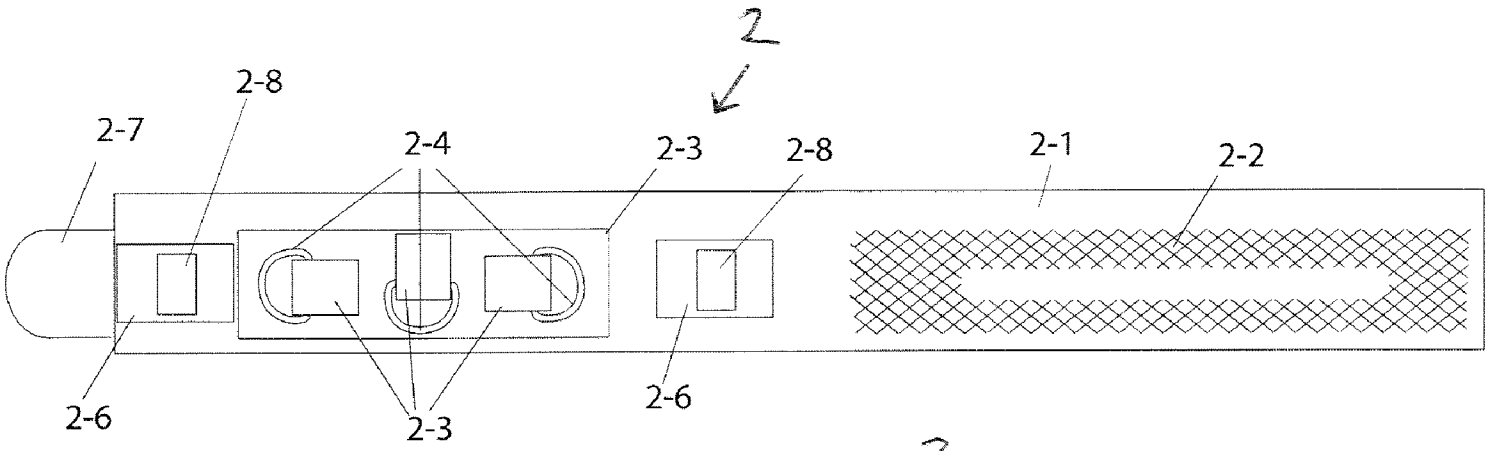
FIG. 2A shows a front side of a thigh/arm sleeve in an embodiment of the invention.
Figure 2B:
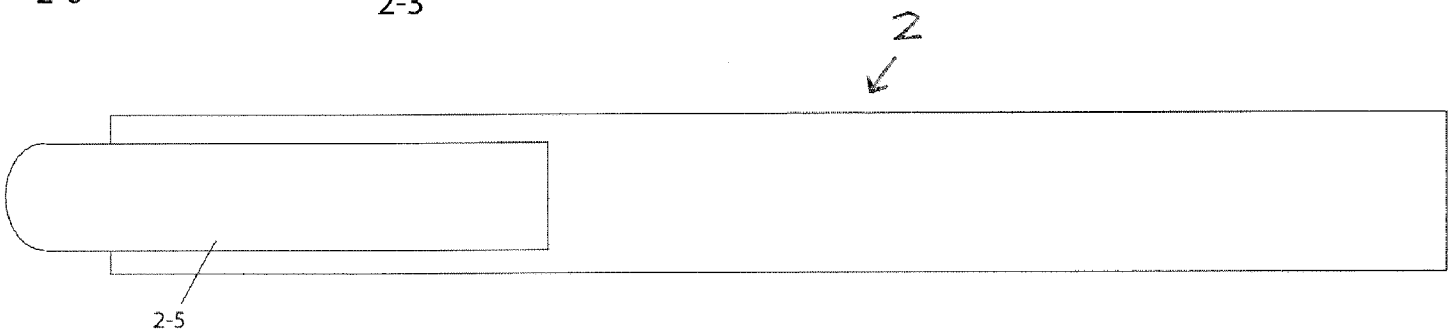
FIG. 2B shows a back side of a thigh/arm sleeve in an embodiment of the invention.

Referring to FIGS. 2A and 2B, an anchor sleeve (2), which may be made from a synthetic rubber such as polychloroprene (2-1), e.g., Neoprene™ (originally known as duprene), is used in an embodiment of the invention. Similar elastic materials may be used in other embodiments. The sleeve may include rubber backing and may be sized to accommodate the thigh of an average person, e.g., an adult. The sleeve may also be used around a person's upper arm; therefore, the term "thigh/arm sleeve" may be used to describe this type of sleeve. A piece of loop material (2-2) is sewn (or otherwise secured) to the polychloroprene side of the sleeve at one end of the sleeve. A piece of nylon webbing (2-3) (or similar material) is sewn to the polychloroprene side of the sleeve at the other end. At least three rings (2-4) (preferably D-rings) are sewn to the nylon webbing. The outer two rings face along a common axis, with a curved portion of each ring facing along this axis. If three rings are present, the ring in the center is referred to as the "center ring;" otherwise, reference is made to a "central ring". The center ring faces along an axis perpendicular (normal) to the axis of the outer rings. A piece of hook material (2-5) is sewn to the rubber side of the sleeve (FIG. 2B). A piece of hook or loop material (called a tab) (2-7) projects about an inch beyond the end of the sleeve and provides extra adhesion. The tab helps to keep the sleeve from riding up or down a person's thigh (or arm) in the course of training due to insufficient adhesion. Pieces of nylon webbing (2-6) are sewn to the polychloroprene side of the sleeve between the loop (2-2) and rings (2-3) and between the rings (2-2) and tab (2-7). Another piece of nylon webbing (2-8) is sewn in the middle of this nylon webbing (2-6) to serve as loops thru which the elastic member (1) (FIG. 1) is passed to keep the elastic member from riding up or down the sleeve (2) in the course of training.

Figure 3:
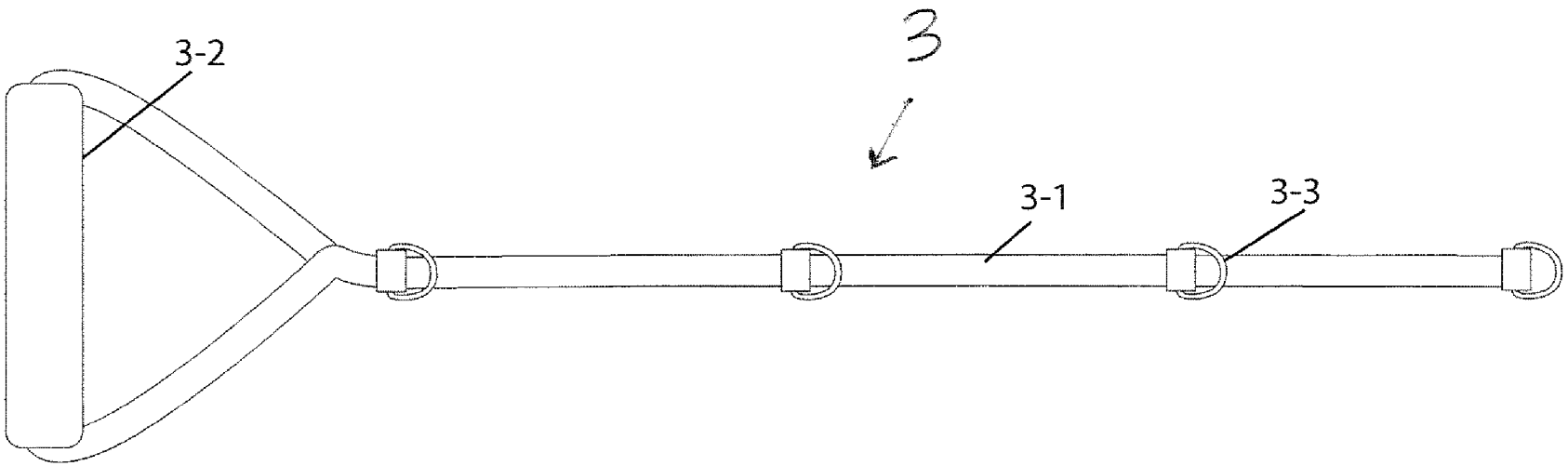
FIG. 3 shows a handle attachment in an embodiment of the invention.

Referring to FIG. 3, an adjustable handle attachment (3) is used in an embodiment of the invention. The handle attachment comprises nylon (or similar material) webbing (3-1) inserted through a tube (3-2) which may be plastic and which may be foam-covered. An end of the nylon webbing is sewn (or otherwise secured) to itself at a point approximately 6" from the tube to form a handle portion. Several rings (3-3) (preferably D-rings) are sewn to the nylon webbing. Preferably, four rings are present, at approximately 6" intervals from the handle portion, but other numbers of rings may be used as well.

Figure 4:
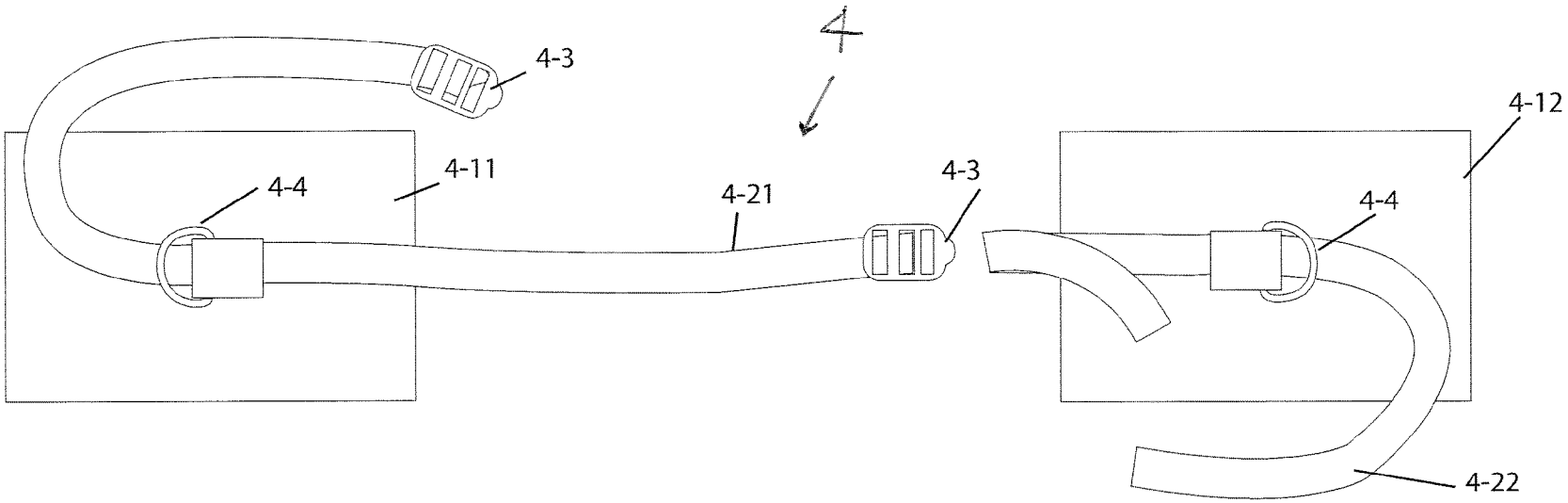
FIG. 4 shows an adjustable harness in an embodiment of the invention.

Referring to FIG. 4, an adjustable harness (4) is used in an embodiment of the invention. The adjustable harness includes two pieces of fabric-covered foam (4-11, 4-12) that cushion the body. Other materials may be used to cushion the body in alternative embodiments. Nylon webbing (4-22) is sewn (or otherwise secured) in the middle of fabric-covered foam piece (4-12). Another piece of nylon webbing (4-21) is sewn in the middle of the other piece of foam (4-11); an adjustable plastic clip (4-3) is sewn to each end of webbing (4-21). A ring (4-4) (preferably a D-ring) is sewn to the center of each webbing. Each end of the webbing (4-22) is passed through one of the clips (4-3) on the webbing (4-21). In lieu of clips, other means for attaching the ends of the webbings may be used in other embodiments.

Figure 5:
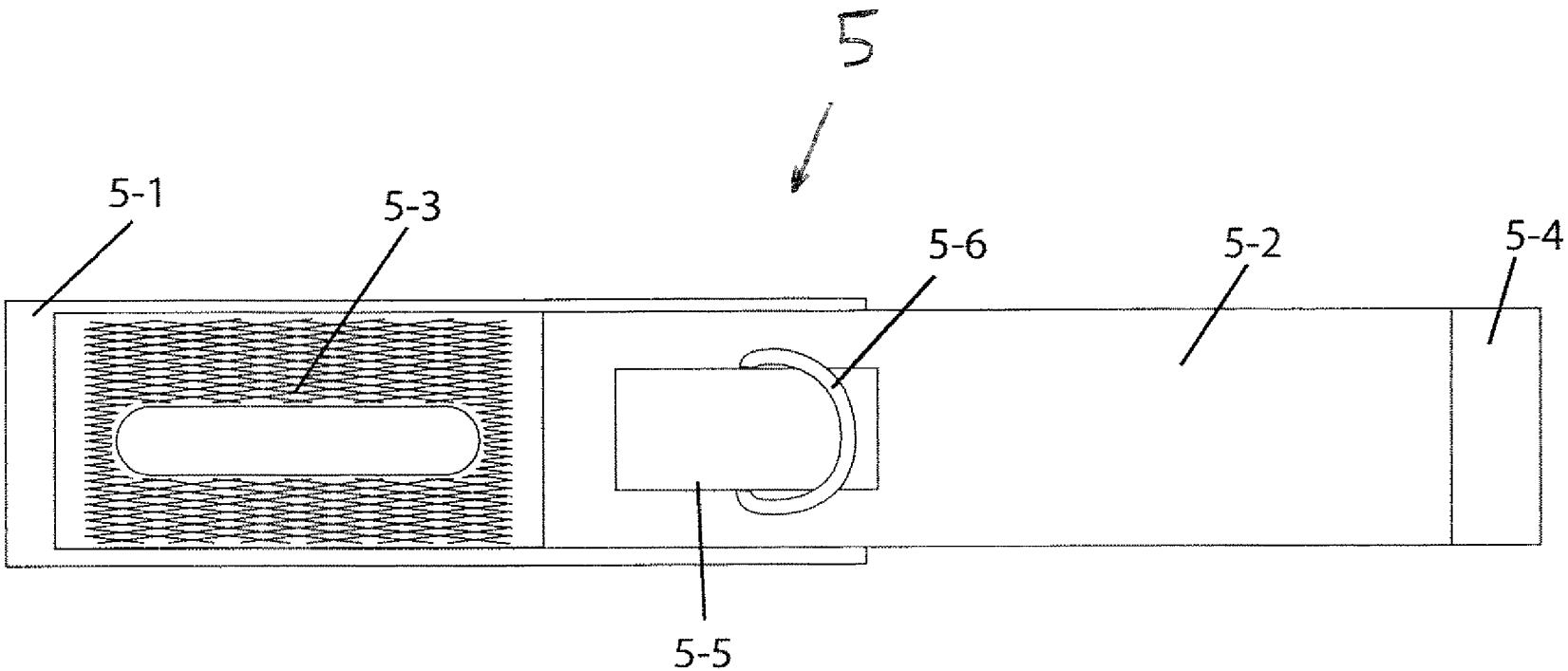
FIG. 5 shows a wrist/ankle sleeve in an embodiment of the invention.

Referring to FIG. 5, a second embodiment of an anchor sleeve is used to wrap around a person's wrist or ankle; this sleeve may be referred to as a "wrist/ankle sleeve" (5). In an embodiment of the invention, the wrist/ankle sleeve is made from a fabric-covered foam material (5-1), sized to accommodate an ankle of a person, to which a piece of nylon webbing (5-2) is sewn. Materials different than fabric-covered foam may be used in alternative embodiments. A piece of loop material (5-3) is sewn to the front of webbing (5-2), and a piece of hook material (5-4) is sewn to the back of the webbing. To this webbing, a smaller piece of nylon webbing is sewn at the center (5-5). A ring (5-6) (preferably a D-ring) is sewn between webbing (5-2) and webbing (5-5).

Some embodiments include an anchor sleeve made from foam or elastic materials, but other materials and other geometries that allow points of anchoring (affixing) elastic members are contemplated.

FIGS. 6-9 show examples of using embodiments of the tool to perform resistance training. In embodiments of the invention, at least one elastic resistance member (1) is used alone or in conjunction with one of the other components described above and in FIGS. 2-5. Numerous combinations of components may be used in various ways to target different areas of the body for resistance training. The following discussion describes several examples of using the components for resistance training but is not exhaustive.

In an embodiment of the invention, for lower body and core (e.g., abdominal and oblique) muscle group work, a thigh/arm sleeve (2) is wrapped around each thigh, approximately mid thigh, centering the portion of each sleeve with the rings on the outermost (outside-facing relative to the user) part of the thigh. The thigh/arm sleeves (2) are secured tightly by overlapping the hook and loop material. A resistance member (1) is clipped to the forward ring on one leg, passed thru the loops on each sleeve and then stretched in front of the legs to clip the other end to the forward ring on the second leg. A second resistance member (1) is clipped to the back ring on the first leg, passed thru the loops on each sleeve, then passed behind the legs to clip the opposite end of the resistance member to the back ring on the second leg. In alternative embodiments, depending on the goal of the workout, a single resistance member (1), in front of or behind the legs, may be used instead of two resistance members.

As the person walks, runs, jumps, or performs any other form of motion moving either or both legs, the resistance member (1) (more precisely, the elastic segment of the resistance member) is stretched, countering muscular contractions associated with moving the leg(s), resulting in resistive training. In other words, the person exerts a force which is resisted by the tendency of the elastic material to return to its unstretched state. Positioning the resistance member (1) above the knees prevents strain on the knees which might result in injury. The swivel clips mitigate chafing against the skin by allowing the hook portion to turn in response to changing geometric configurations.

Figure 6:
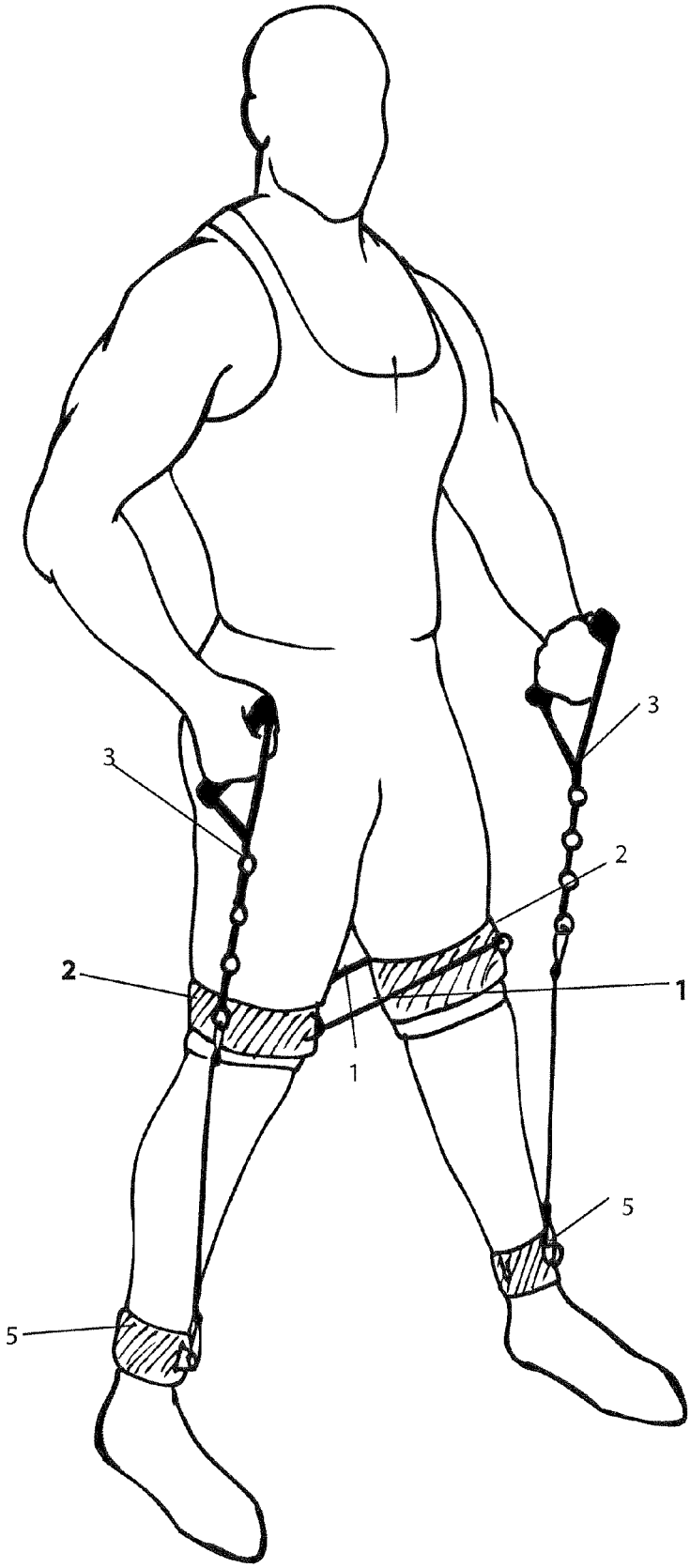
FIG. 6 shows a way to use thigh/arm sleeves, wrist/ankle sleeves, handle attachments, and elastic resistance members in an embodiment of the invention.

Referring to FIG. 6, in another embodiment of the invention, a resistance member (1) is attached to the handle (3) attachment by clipping one end of the resistance member (1) to a ring on the handle (3) attachment. The choice of ring determines the length to which the resistance member (1) will be stretched (and thus the level of resistance that will be encountered). The opposite end of the resistance member is then clipped to a ring on the wrist/ankle sleeve (5) (which is wrapped around an ankle), as shown in FIG. 6. A person may grip the handle (3) portion and move the handle (3) attachment so as to extend (stretch) the resistance member (1) in accordance with resistance training. As shown in FIG. 6, handle (3) attachments and wrist/ankle sleeves may be used in conjunction with thigh/arm sleeves (2).

Figure 7:
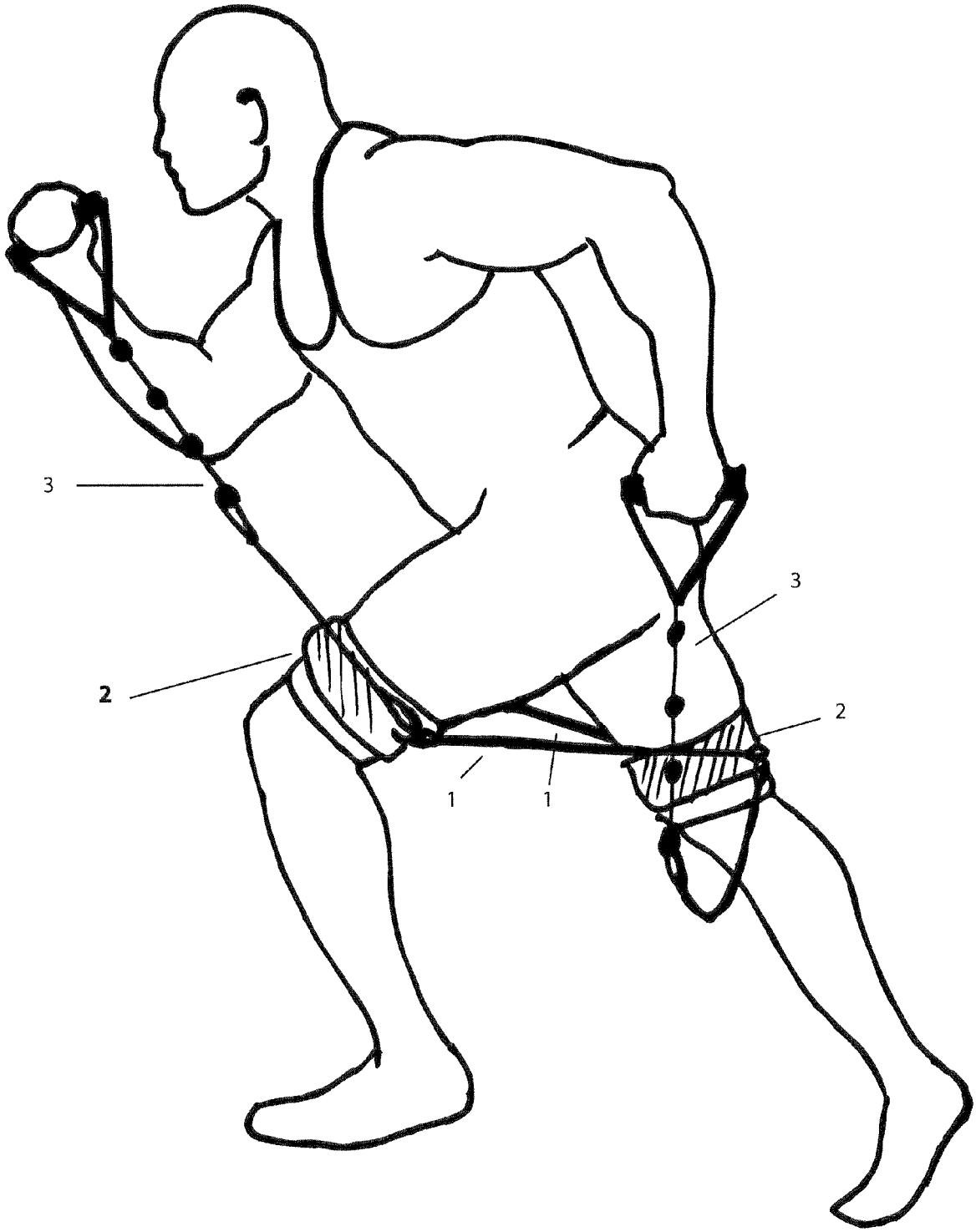
FIG. 7 shows a way to use thigh/arm sleeves, handle attachments, and elastic resistance members in an embodiment of the invention.

In another embodiment shown in FIG. 7, thigh/arm sleeves (2) (instead of wrist/ankle sleeves (5) as described above) may serve to anchor resistance members.

Figure 8:
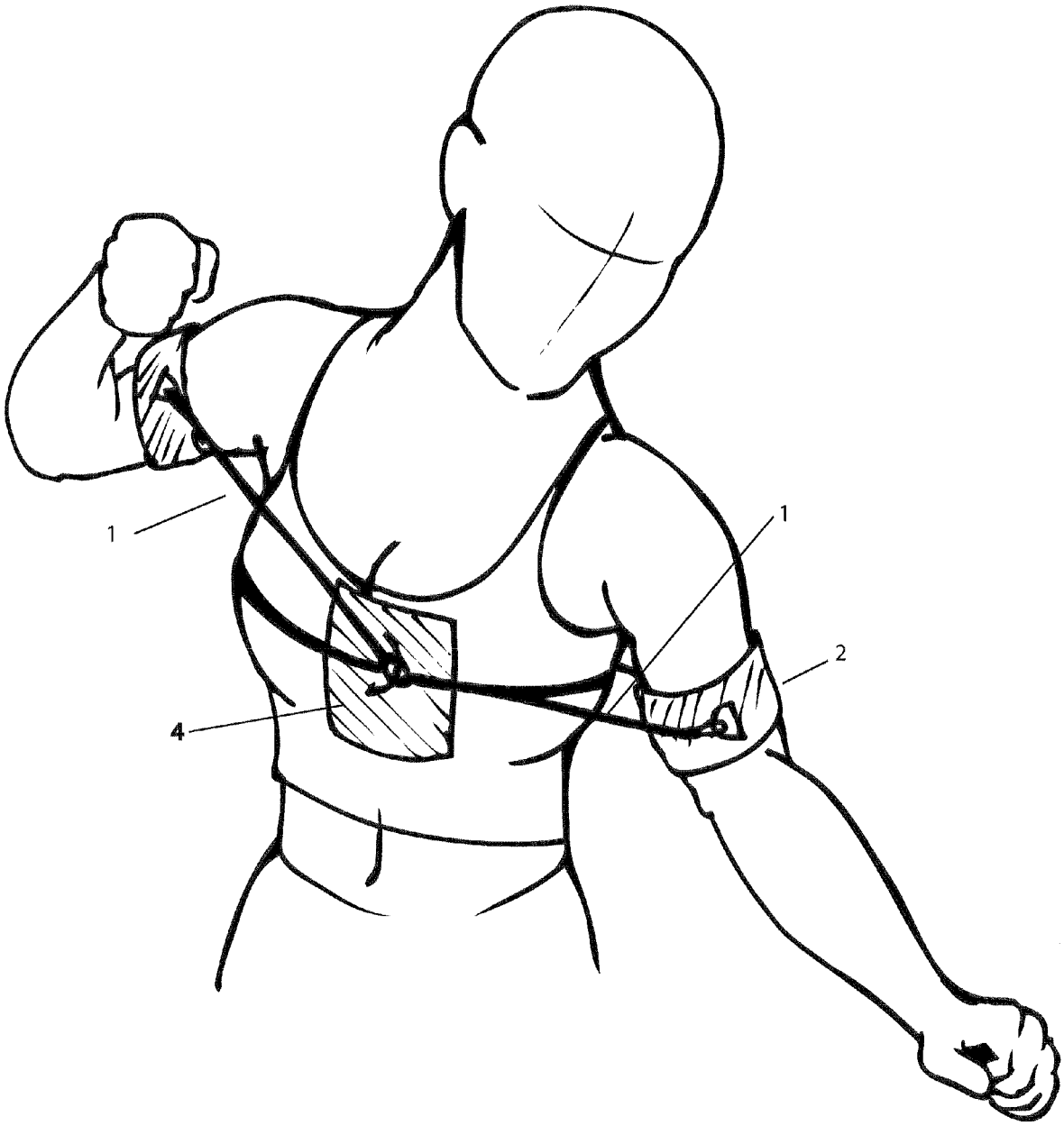
FIG. 8 shows a way to use an adjustable harness, thigh/arm sleeves, and elastic resistance members in an embodiment of the invention.

In another embodiment of the invention shown in FIG. 8, for upper-body work, an adjustable harness (4) is placed over the head with one of the pieces of fabric-covered foam positioned on the center of the chest and the other piece centered on the back. Each end of the webbing that does not have clips webbing is pulled through one of the clips until the harness is snug against the body. By clipping one end of a resistance member (1) to one of the rings of the harness and the other end to a thigh/arm sleeve (2) wrapped around an upper arm, a person may train with resistance during arm movements (e.g., throwing a football or boxing).

Figure 9:
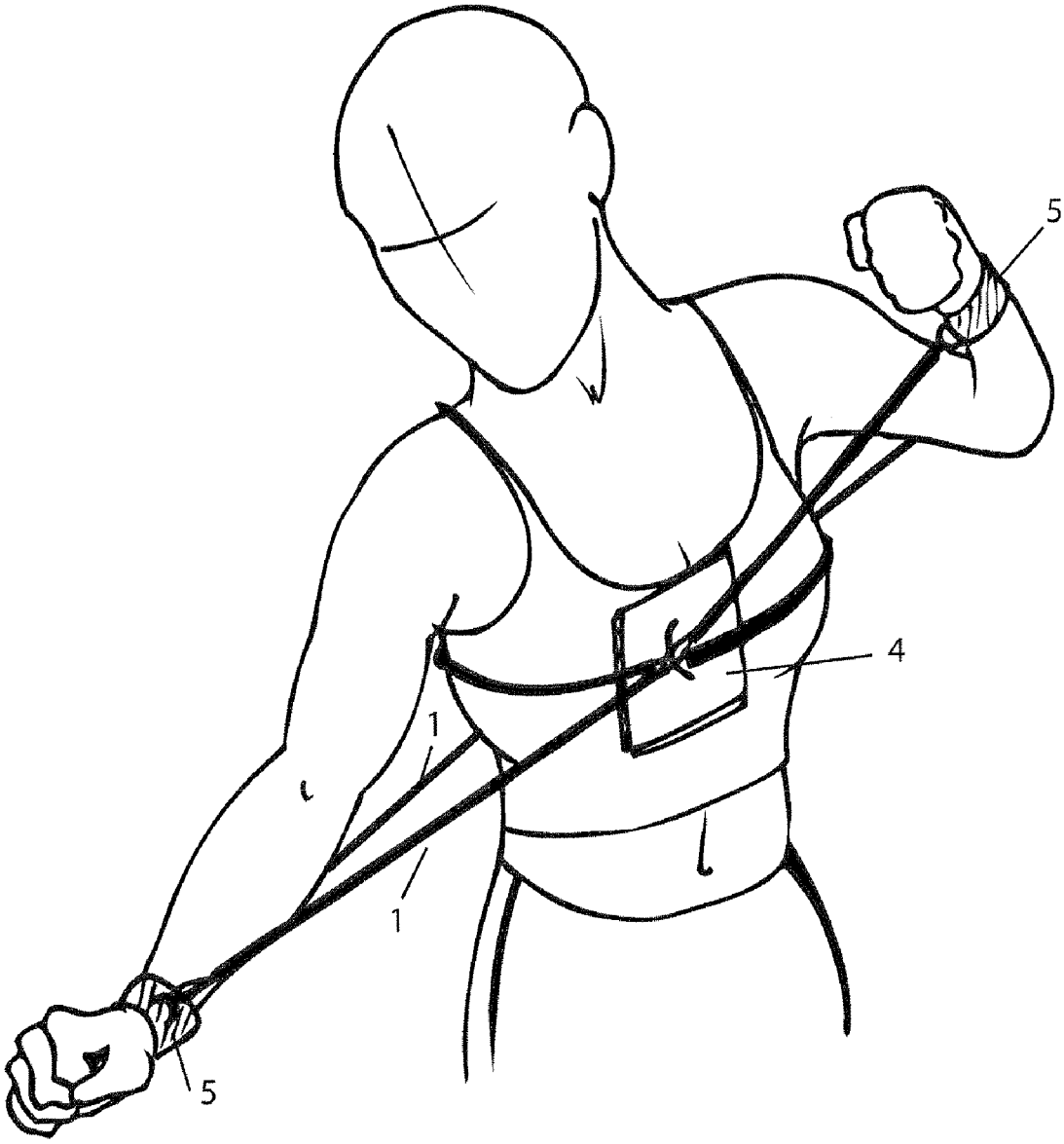
FIG. 9 shows a way to use an adjustable harness, wrist/ankle sleeves, and elastic resistance members in an embodiment of the invention.

A wrist/ankle sleeve (5) (instead of a thigh/arm sleeve) may be used in conjunction with the harness (4) in another embodiment, as shown in FIG. 9. A wrist/ankle sleeve (5) is wrapped around a wrist and secured by the hook and loop materials, centering the ring on the outer side of the wrist. To provide for resistance training, resistance members (1) are clipped at one end to the ring on the wrist/ankle sleeve (5) and at the other end to a ring of the harness.

As previously mentioned, embodiments of the present invention may use various configurations of components described above. In various embodiments, any of a thigh/arm sleeve (2), wrist/ankle sleeve (5), harness (4), or handle attachment (3) may be used in conjunction with another of these components and a resistance member (1). Any of these components may be used in conjunction with a resistance member (1) and a fixed object (e.g., a hook on a wall) in other embodiments. The "fixed object" may even be a hook clipped to another person, promoting two-person exercises where at least one person moves against resistance. Multiple resistance members (1) may be linked together, either directly or via a ring to which each resistance member (1) is clipped, to provide greater overall length and thus even more options.

Resistance may be varied by adjusting the effective length or thickness of resistance members (1). In this context, effective length means the length of elastic material directly subjected to a stretching force, effective thickness means the dimension of the wall of tubing material directly subjected to a stretching force. As described above, the effective length may be increased by chaining multiple resistance members together. Effective length may be decreased by selecting appropriate rings to which to clip resistance members or by constraining sections of a resistance member, thus preventing them from being directly stretched. For example, the elastic material may be passed through the center ring of a thigh/arm sleeve (2) to shorten the effective length of the resistance member and thus increase resistance. Thus, the center ring accommodates smaller-sized individuals (e.g., children); previously, separate (shorter) resistance members (1) with greater resistance were needed for such individuals. Of course, varying lengths of resistance members (1) may be used for varying amounts of resistance in embodiments of the present invention as well. In some embodiments of the invention, different colors are used to indicate different lengths or thickness of the tubing (and thus different resistance levels) of resistance members (1).

While this invention has been particularly shown and described with references to example embodiments thereof, it will be understood by those skilled in the art that various changes in form and details may be made therein without departing from the scope of the invention encompassed by the appended claims.

What is claimed is:

1. A resistance training tool comprising:

a first anchor sized and configured for attachment to a limb of a person's body; and first and second elastic resistance members each having one end attachable to the first anchor and extendable on opposite sides of the first anchor for extending on opposite sides of the limb and capable of being additionally passed through respective loops secured to the first anchor to keep the elastic resistance members from riding up and down the first anchor during training, an opposite end of the elastic resistance members being attachable to a second anchor.

2. The tool of claim 1 in which each elastic resistance member comprises:

an elastic segment; and a swivel clip, attached to each end of the elastic segment, that rotates independently of the elastic segment about an axis defined by the length of the elastic segment.

3. The tool of claim 2 wherein the swivel clip includes a hook portion with an openable and closable loop including the hook portion.

4. The tool of claim 2 in which the first anchor comprises a thigh/arm sleeve, the thigh/arm sleeve comprising:

a main portion sized so as to accommodate a thigh of a person;

hook-and-loop securing portions for securing one end of the main portion to the other end;

a tab portion projecting beyond an end of the main portion for attachment; and at least one ring secured to the thigh/arm sleeve, the ring enabling clipping of a resistance member to the thigh/arm sleeve.

5. The tool of claim 4 wherein the thigh/arm sleeve includes at least three rings, and wherein:

the rings are arranged in a row;

rings at each end are positioned along a first axis; and a center ring is positioned along a second axis normal to the first axis.

6. The tool of claim 2 further comprising a handle attachment, the handle attachment comprising:

a webbing member;

a handle portion attached at one end of the webbing member; and at least one ring secured to the webbing member.

7. The tool of claim 2 further comprising a harness, the harness comprising:

at least one webbing member;

attachment portions for attaching the at least one webbing member around the torso of a person; and at least one ring secured to the at least one webbing member.

8. The tool of claim 2 further comprising a wrist/ankle sleeve, the wrist/ankle sleeve comprising:

a member sized so as to fit around an ankle of a person;

securing portions for securing one end of the member to the other end; and at least one ring secured to the member.

9. The tool of claim 1 in which the first and second anchors are fixed to a person's respective thighs.

10. A method of resistance training comprising:

attaching one end of first and second elastic resistance members to a first anchor that is fixed to a limb of a person's body, the first and second elastic resistance members extending on opposite sides of the first anchor and the limb, the limb being an arm, and the first anchor being fixed to an upper arm;

attaching the other end of the elastic resistance members to a material fixed to the torso area of a person; and moving the arm.

11. A method of resistance training comprising:

attaching one end of first and second elastic resistance members to a first anchor that fixed to a limb of a person's body, the first and second elastic resistance members extending on opposite sides of the first anchor and the limb and additionally passing through respective loops secured to the first anchor to keep the elastic resistance members from riding up and down the first anchor during training;

attaching the other end of the elastic resistance members to a second anchor; and moving the limb.

12. The method of claim 11 in which at least one elastic resistance member is sized and configured for attachment to one of a wrist, an upper arm, a torso, a thigh, an ankle, another person, and a fixed object.

13. The method of claim 11 further comprising fixing the first and second anchors to a person's respective thighs.

14. A method of resistance training comprising:

attaching one end of first and second elastic resistance members to a first anchor that is fixed to a limb of a person's body, the first and second elastic resistance members extending on opposite sides of the first anchor and the limb, the limb being an arm;

attaching the other end of the elastic resistance members to a harness fixed to a torso area of the person, the harness having two harness members secured to the torso with a strap, one harness member positioned on a central chest area, and the other harness member on a central back area, each harness member having an attachment member for securement to the resistance members; and moving the arm.

15. The method of claim 14 further comprising fixing the first anchor to an upper arm.

16. The method of claim 14 further comprising fixing the first anchor to a wrist.

17. A resistance training tool comprising:

a first anchor sized and configured for attachment to a limb of a person's body;

first and second elastic resistance members each having one end attachable to the first anchor and extendable on opposite sides of the first anchor for extending on opposite sides of the limb, the limb being an arm; and a harness fixable to a torso area of the person, the harness having two harness members securable to the torso with a strap, one harness member positionable on a central chest area, and the other harness member on a central back area, each harness central chest area, and the other harness member on a central back area, each harness member having an attachment member for securement to the other end of the elastic resistance members.

18. The tool of claim 17 in which the first anchor is sized and configured for attachment to an upper arm.

19. The tool of claim 17 in which the first anchor is sized and configured for attachment to a wrist.

* * * * *

UNITED STATES PATENT AND TRADEMARK OFFICE

CERTIFICATE OF CORRECTION

PATENT NO. : 8,002,681 B2
APPLICATION NO. : 12/607783
DATED : August 23, 2011
INVENTOR(S) : Todd Kopp It is certified that error appears in the above-identified patent and that said Letters Patent is hereby corrected as shown below:

In Column 8, Claim 17, lines 39 and 40, please delete "central chest area, and the other harness member on a central back area, each harness".

Signed and Sealed this
Eighth Day of November, 2011

David J. Kappos

David J. Kappos
*Director of the United States Patent and Trademark Office*